US005364243A

United States Patent [19]

Ishimoto

[11] Patent Number: 5,364,243

[45] Date of Patent: Nov. 15, 1994

[54] FUEL INJECTION PUMP

[75] Inventor: Masayori Ishimoto, Saitama, Japan

[73] Assignee: Diesel Kiki Co., Ltd., Japan

[21] Appl. No.: 16,665

[22] Filed: Feb. 10, 1993

Related U.S. Application Data

[63] Continuation of Ser. No. 845,860, Mar. 3, 1992, abandoned, which is a continuation of Ser. No. 553,102, Jul. 13, 1990, abandoned.

[30] Foreign Application Priority Data

Aug. 2, 1989 [JP] Japan ..... 1-99155[U]

[51] Int. Cl.[5] ..... F04B 7/04

[52] U.S. Cl. ..... 417/499; 123/503

[58] Field of Search ..... 417/494, 499; 123/447, 123/449, 503

[56] References Cited

U.S. PATENT DOCUMENTS

| | | | |
|---|---|---|---|
| 3,624,823 | 11/1971 | Staudt et al. | 417/499 |
| 3,989,021 | 11/1976 | Koboyashi et al. | 123/503 |
| 4,413,600 | 11/1983 | Yanagawa et al. | 417/494 |
| 4,441,868 | 4/1984 | Fiedler et al. | 417/499 |
| 4,494,513 | 1/1985 | Torizuka | 417/499 |
| 4,561,398 | 12/1985 | Roca Nierga | 123/449 |
| 4,573,442 | 3/1986 | Matsumura et al. | 123/503 |
| 4,611,566 | 9/1986 | Kampichler et al. | 417/499 |
| 4,630,586 | 12/1986 | Guntert et al. | 123/503 |
| 4,721,442 | 1/1988 | Tanaka | 417/499 |
| 4,737,086 | 4/1988 | Yamaguchi et al. | 123/503 |
| 4,763,631 | 8/1988 | Fehlmann et al. | 123/449 |
| 4,811,716 | 3/1989 | Guntert et al. | 123/503 |
| 4,870,936 | 10/1989 | Eheim et al. | 123/503 |

*Primary Examiner*—Richard A. Bertsch
*Assistant Examiner*—Michael I. Kocharov
*Attorney, Agent, or Firm*—Ostrolenk, Faber, Gerb & Soffen

[57] ABSTRACT

In a fuel injection pump including a plunger barrel provided with a fuel pressure chamber, a plunger which reciprocates within this plunger barrel to take in fuel from a fuel reservoir chamber and deliver this fuel from the fuel pressure chamber under pressure, and a timing sleeve which is positioned between the plunger and the plunger barrel such that it slidably mates with the outside of this plunger, and on which a spill port is formed; a fuel injection pump is characterized by an impingement-cushioning cavity being formed on the surface of the inside wall of the plunger barrel in a position opposite the spill port of the timing sleeve along with the peripheral surface of the timing sleeve being formed in a certain shape corresponding to this impingement-cushioning cavity.

4 Claims, 4 Drawing Sheets

FUEL INJECTION PUMP

This is a continuation of application Ser. No. 07/845,860 filed on Mar. 3, 1992, now abandoned, which is a continuation of application Ser. No. 07/553,102, filed on Jul. 13, 1990, now abandoned.

BACKGROUND OF THE INVENTION

1. Field of the Invention

This invention relates to a fuel injection pump equipped with a pre-stroke varying mechanism used in diesel engines or other internal combustion engines, and particularly to a fuel injection pump which is able to prevent cavitation erosion due to spillage of high-speed, high-pressure fuel into the fuel reservoir chamber.

2. Description of the Prior Art

Conventional fuel injection pumps are provided with pre-stroke varying mechanisms used to vary their pre-strokes, and typically the pre-stroke is varied by adjusting the relative positions of a vertically-reciprocating plunger and a timing sleeve which mates to the outside of the plunger. For example, Japanese Utility Publication No. 62(1987)-8381 and others may be cited.

Cavitation erosion occurring in the pump housing of such a fuel injection pump 1 equipped with such a pre-stroke varying mechanism is described in Japanese Patent Publication No. 55(1980)-93959, Japanese Patent Publication No. 57(1982)-59054, Japanese Utility Publication No. 58(1983)-109554 and others.

Furthermore, in the fuel injection pump of Japanese Utility Publication No. 61(1986)-167469 in which a cavity is formed on the plunger barrel to prevent cavitation erosion, the spilled high-pressure fuel is assumed to be forced to collide with only the plunger barrel so that the cavity cushions this high pressure. Therefore, although the pump itself may be protected, protection of the plunger barrel is difficult.

Here follows a description of cavitation erosion which occurs in the plunger barrel located on the outside of the timing sleeve and the pump housing, made with reference to FIGS. 4 through 6.

FIG. 4 is a vertical cross section through a portion of a fuel injection pump 1 in which the same number of vertical holes 3 as the number of cylinders in the engine are formed in its pump housing 2. A plunger barrel 4 is inserted into each vertical hole 3 and secured with anchor bolts 5. A plunger 6 is inserted into the plunger barrel 4 such that it is capable of rotary and reciprocating motion.

As shown in FIGS. 5 and 6, a fuel reservoir chamber 8 is formed within the plunger barrel 4 by providing open windows 7 on the left and right, perpendicular to the length of the plunger barrel 4. This fuel reservoir chamber 8 encloses a timing sleeve 9 able to move vertically within it. This timing sleeve 9 mates to the outside of the plunger 6 such that it is positioned between the plunger 6 and the plunger barrel 4. The fuel reservoir chamber 8 is continuously supplied by a fuel supply pump 11 with fuel from a fuel tank 10.

A delivery valve 12 is provided within the plunger barrel 4 above this plunger 6, and the space between this delivery valve 12 and the plunger 6 forms a fuel pressure chamber (plunger chamber) 13. Furthermore, a fuel outlet 15 is formed in a delivery valve holder 14 above the delivery valve 12, and connected via a fuel injector 16 to a fuel injection nozzle 17.

In addition, the lower edge of the plunger 6 is in contact with a cam connected to the engine (both not shown) so that it is made to reciprocate vertically in the diagram with the rotary motion of the engine.

Furthermore, a driving face (not shown) is formed on the lower portion of this plunger 6, and this driving face engages an injection quantity-adjusting sleeve 18. By rotating this injection quantity-adjusting sleeve 18 with an injection quantity-adjusting control rack 19 connected to an accelerator pedal (not shown), the plunger 6 is rotated to change the engagement position of a control lead groove 27 and cutoff hole 30 (to be described hereafter), thereby changing the effective stroke of fuel delivery under pressure, and thereby adjusting the quantity of fuel injected.

Formed in the timing sleeve 9 are a vertical guide groove 20 in the right center of FIG. 4 and a lateral engaging groove 21 in the left center of FIG. 4, respectively. A guide pin 22 provided on the plunger barrel 4 engages the guide groove 20, while a control rod 23 is inserted into the engaging groove 21.

This control rod 23 is inserted through a lateral hole 24 formed in the pump housing 2 and is rotatably supported by the pump housing 2 with bearings (not shown). The control rod 23 is linked to a step motor or other actuator (not shown) and driven by the actuator based on the engine speed or other detected signal.

Thus, the pre-stroke may be adjusted by moving the timing sleeve 9 vertically with the control rod 23. To wit, the pre-stroke of the plunger 6 is defined to be its distance of travel from the lower edge of the timing sleeve 9 to a fuel suction and exhaust hole 25 (to be described later) at the bottom dead center position of the plunger 6 or the distance of travel from the bottom dead center position of the plunger 6 until the fuel suction and exhaust hole 25 closes, so that fuel injection begins when the fuel suction and exhaust hole 25 is closed.

Furthermore, in FIG. 4, when the plunger 6 slidably inserted into the plunger barrel 4 is driven by the rotary motive power of the engine so that it reciprocates within the plunger barrel 4, fuel within the fuel reservoir chamber 8 is sucked into the fuel pressure chamber 13 and then the fuel within this fuel pressure chamber 13 is delivered under pressure from the fuel outlet 15 through the fuel injector 16 and injected from the fuel injection nozzle 17.

To wit, this plunger 6 is provided with this radially-oriented fuel suction and exhaust hole 25 which acts as a fuel inlet port open to the fuel reservoir chamber 8, a connecting hole 26 formed to connect this fuel suction and exhaust hole 25 and the fuel pressure chamber 13 in the central axis direction, the control lead groove 27 formed at an inclination on its outer surface, and a connecting vertical groove 28 which serves to connect this control lead groove 27 and the opening of the fuel suction and exhaust hole 25. Note that an auxiliary hole 29 may also be provided on the plunger 6 in the radial direction to connect the top of this connecting vertical groove 28 to the connecting hole 26.

Furthermore, a cutoff hole 30 which acts as a spill port is formed in a radial direction completely through the timing sleeve 9 which slidably mates to the outside of the plunger 6. This cutoff hole 30 is disposed in such a vertical position that it is able to connect to the control lead groove 27 in response to the vertical motion of the plunger 6.

In this configuration, when the plunger 6 first rises from its bottom dead center position, the fuel suction and exhaust hole 25 opens to the fuel reservoir chamber 8 so that this fuel reservoir chamber 8 is connected to the fuel pressure chamber 13 by the fuel suction and exhaust hole 25 and the connecting hole 26, so the pressure of the fuel in the fuel pressure chamber 13 does not rise and the delivery valve 12 remains closed.

To deliver fuel, the plunger 6 rises and the pressure of the fuel within the fuel pressure chamber 13 increases as the fuel suction and exhaust hole 25 is closed by the timing sleeve 9, at which time, the delivery valve 12 opens to deliver fuel from the fuel outlet 15 and injection (delivery of fuel under pressure) begins.

As the plunger 6 rises further, the control lead groove 27 connected to the fuel suction and exhaust hole 25 connects to the cutoff hole 30 in the timing sleeve 9, causing the cutoff hole 30 to be connected to the fuel pressure chamber 13 through the cutoff hole 30, the control lead groove 27, the connecting vertical groove 28 and auxiliary hole 29 and the connecting hole 26, so that fuel in the fuel pressure chamber 13 flows back to the fuel reservoir chamber 8, lowering the fuel pressure within the fuel pressure chamber 13, and then the delivery valve 12 closes and injection (delivery of fuel under pressure) ends.

However, when this fuel sprays, or rather, spills so that it flows back into the fuel reservoir chamber 8, the flow of high-speed, high-pressure fuel is suddenly released and collides with the inside wall 4A of the plunger barrel 4, and the flow is then redirected along the inside wall 4A so that it collides with the inside wall 2A of the pump housing 2 at an angle of collision AN (refer to the arrow in FIG. 6). Therefore, the problem of cavitation erosion (hereinafter called simply "erosion") E (indicated by groups of dots in FIG. 6) occurs in which the surfaces of the inside walls 4A and 2A are worn or damaged by repeated generation of bubbles by negative pressure and their subsequent collapse due to the next fuel pressure wave.

Note that as shown in FIG. 6, both the distance D1 from the cutoff hole 30 to the inside wall 4A of the plunger barrel 4 and the distance D2 from the point at which fuel sprayed from the cutoff hole 30 collides with the inside wall 4A to inside wall 2A of the pump housing 2 are short distances over straight lines.

Moreover, there are restricting areas 31 between the inside wall 4A of the plunger barrel 4 and the peripheral surface of the timing sleeve 9; these restricting areas 31 cause the fuel pressure to rise, resulting in the fuel colliding with the inside walls 4A and 2A at higher speeds and higher pressures, increasing the effect of these collisions and promoting the occurrence of the erosion E described heretofore.

Thus, there is a problem in that the occurrence of erosion E as such reduces the durability of the pump housing 2 and plunger barrel 4.

SUMMARY OF THE INVENTION

The present invention came about in light of the above, and its object is to provide, in a fuel injection pump provided with a pre-stroke varying mechanism, a fuel injection pump which is able to prevent erosion which occurs on the inside walls of the plunger barrel and pump housing, thereby improving the durability of the pump housing and plunger barrel.

To wit, the present invention comprises, in a fuel injection pump comprising: a plunger barrel provided with a fuel pressure chamber, a plunger which reciprocates within this plunger barrel to take in fuel from a fuel reservoir chamber and deliver this fuel from the fuel pressure chamber under pressure, and a timing sleeve, positioned between the plunger and the plunger barrel such that it slidably mates with the outside of this plunger, on which is formed a spill port; a fuel injection pump characterized by an impingement-cushioning cavity being formed on the surface of the inside wall of the plunger barrel in a position opposite the spill port of the timing sleeve to prevent the occurrence of erosion.

Furthermore, the invention comprises a fuel injection pump in which, together with the formation of the above impingement-cushioning cavity, by giving the peripheral surface of the timing sleeve an arbitrary shape, e.g., a curved surface of a curvature which depends on the curvature of this impingement-cushioning cavity, the direction of the flow of fuel sprayed out may be appropriately controlled while the distance over which fuel travels before colliding with the pump housing can be extended without restricting the fuel and thereby dispersing the spray flow, thereby reducing the effect on the pump housing inner wall of the flow of fuel after colliding with the plunger barrel.

With the fuel injection pump of the invention, an impingement-cushioning cavity is formed in the inner wall of the plunger barrel opposite the spill port of the timing sleeve, thereby not only does the fuel sprayed out accompanying the end of pressurized delivery of fuel travel a greater distance before reaching the inside wall of the plunger barrel, but after colliding with this inside wall, fuel which then travels toward the inside wall of the pump housing must also travel over a greater distance before reaching this wall, so by lowering the pressure of the fuel, the occurrence of erosion can be suppressed and the durability of the plunger barrel and pump housing increased.

DETAILED DESCRIPTION OF THE PREFERRED EMBODIMENT

Figure 1:
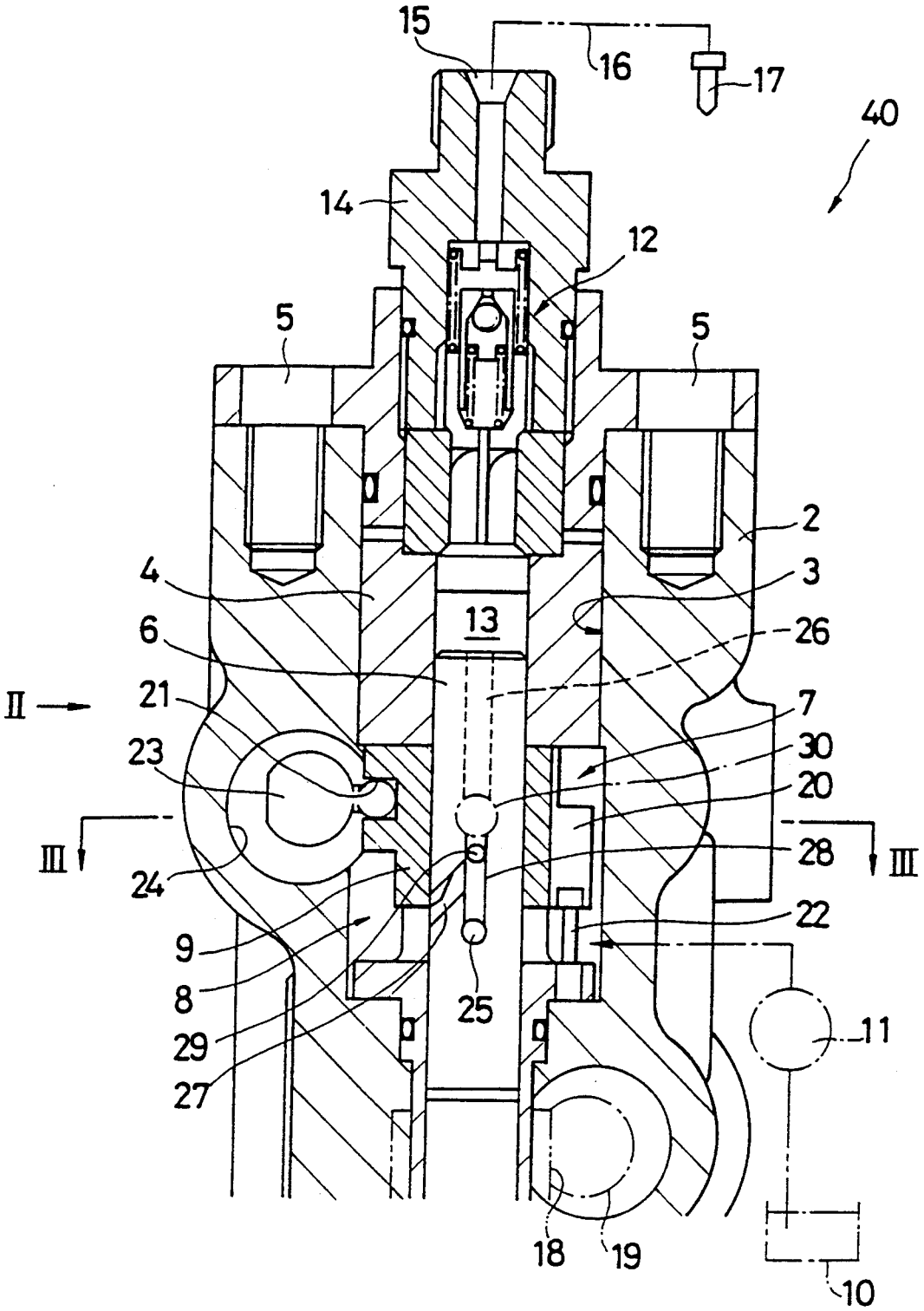
FIG. 1 is a vertical cross section through a portion of a fuel injection pump 40 as one preferred embodiment of the invention.
Figure 2:
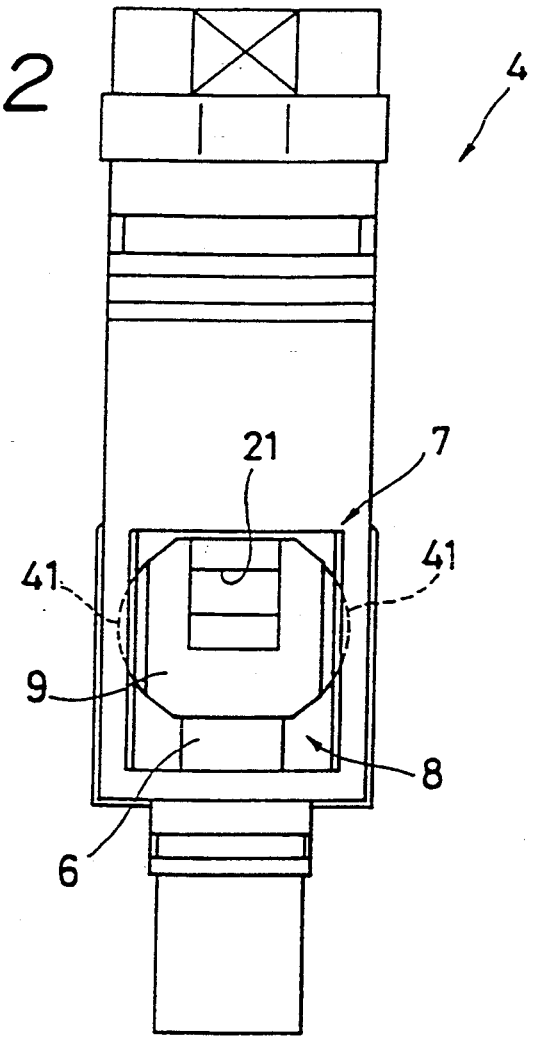
FIG. 2 is a front view of the plunger barrel 4 seen from the direction of arrow II in FIG. 1.
Figure 3:
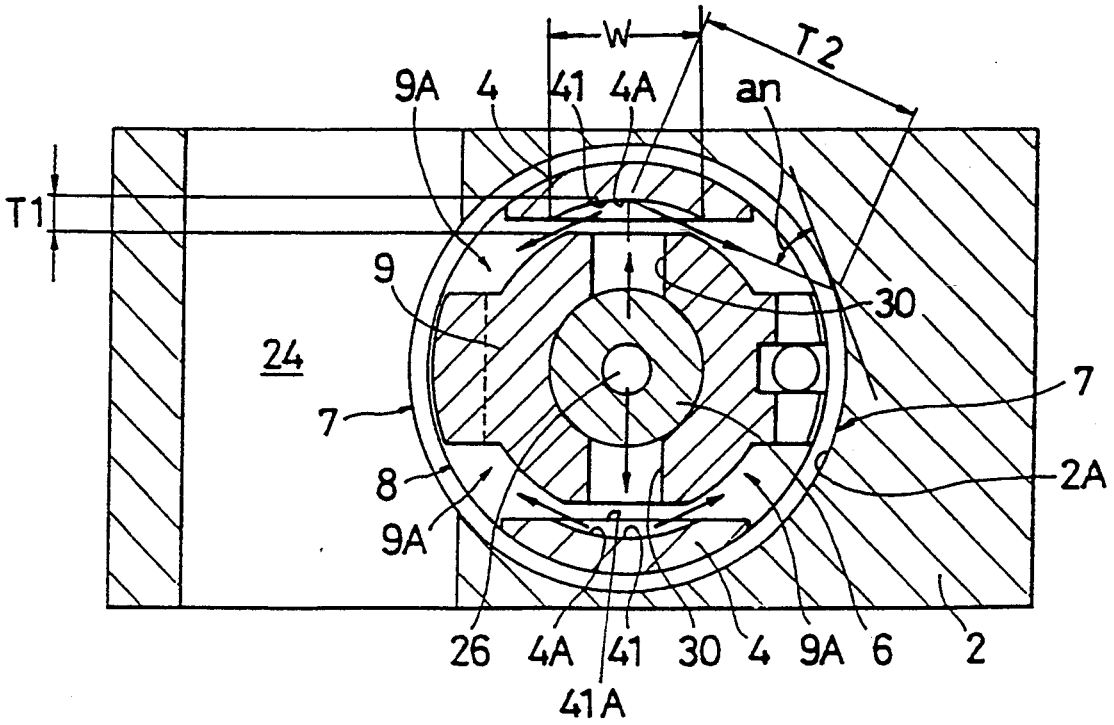
FIG. 3 is a cross section along line III—III of FIG. 1
Figure 5:
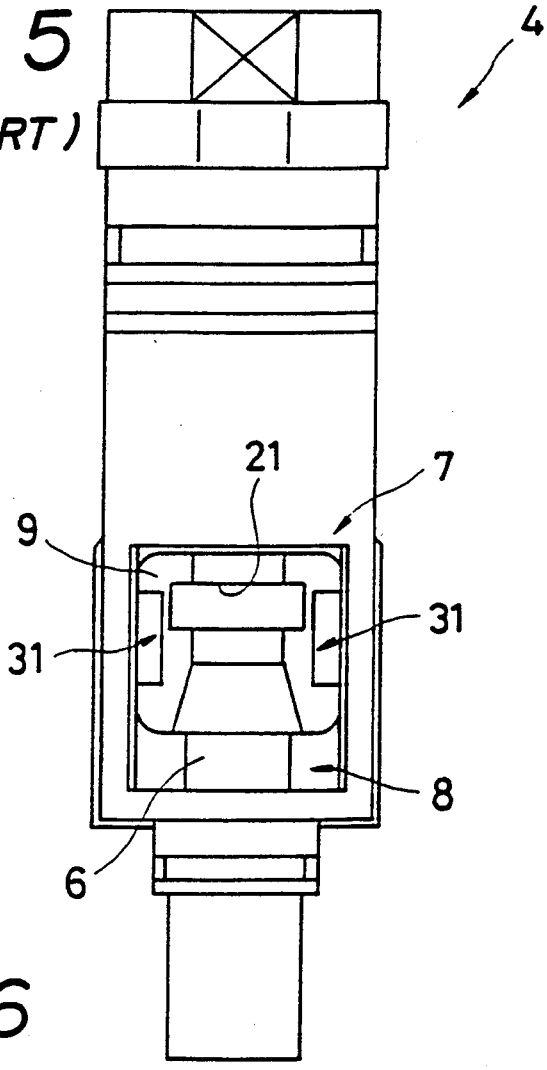
FIG. 5 (PRIOR ART)
FIG. 5 is a front view of the plunger barrel 4 seen from the direction of arrow V in FIG. 4.
Figure 6:
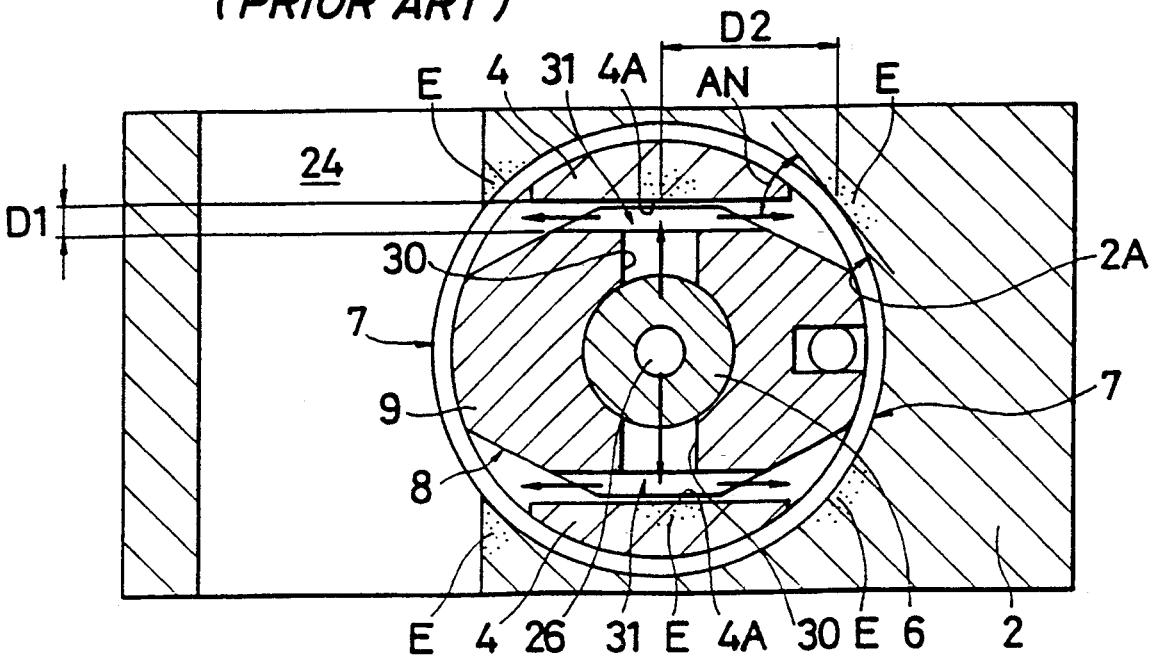
FIG. 6 (PRIOR ART)
FIG. 6 is a cross section along line VI—VI of FIG. 4.

Here follows a description of one preferred embodiment of the fuel injection pump 40 of the invention with reference to FIGS. 1 through 3. Note that portions which are identical to those of FIGS. 4 through 6 are given the same symbols and their detailed description is omitted.

Figure 4:
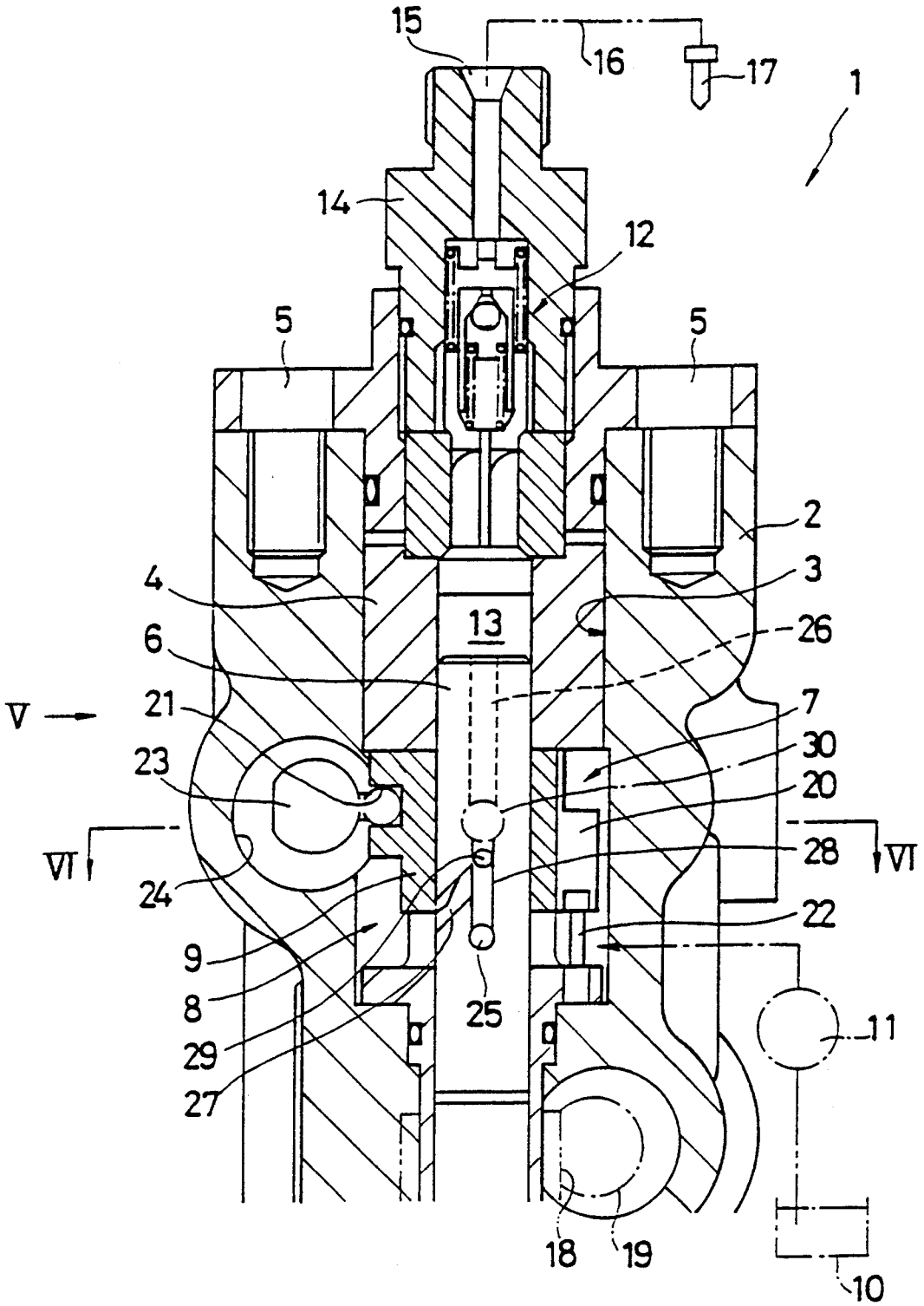
FIG. 4 (PRIOR ART)
FIG. 4 is a vertical cross section through a portion of a conventional fuel injection pump 1.

FIG. 1, like FIG. 4, is a vertical cross section through a portion of a fuel injection pump 40 which differs from the conventional fuel injection pump 1 shown in FIG. 1 particularly in that, as shown in FIG. 3, an impingement-cushioning cavity 41 is formed in a portion of the inside wall 4A of plunger barrel 4 opposite the cutoff hole 30 of the timing sleeve 9. The impingement-cushioning cavity 41 including an open end 41A having a width W. The balance of the structure is essentially identical to the fuel injection pump 1, so we will omit its description.

Note that the curvature of the impingement-cushioning cavity 41 may be arbitrarily designed depending on the pressure of fuel from the cutoff hole 30 or other factors.

Furthermore, by forming the peripheral surface 9A of the timing sleeve 9 in the shape of a curved surface having a certain curvature which depends on the curvature of this impingement-cushioning cavity 41, the spilled fuel which collides with the impingement-cushioning cavity 41 can be made to travel a longer distance T2 before it reaches the inside wall 2A, and the angle of collision an can be made smaller than the above angle of collision AN.

Therefore, as shown in FIG. 3, since the distance T1 traveled by the fuel from the cutoff hole 30 before reaching the inside wall 4A is greater than distance D1 in the prior art, the effects of the collision with this inside wall 4A is reduced.

Furthermore, the distance T2 traveled by the fuel from this inside wall 4A before reaching the inside wall 2A is greater than distance D2 in the prior art. Namely, the curvature of the impingement-cushioning cavity 41 of inside wall 4A and the shape of the peripheral surface of the timing sleeve 9 redirects the fuel sprayed out, so there is no restriction and the distance the fuel travels before colliding with the inside wall 2A of the pump housing 2 is increased, so the occurrence of erosion E is prevented and the durability of the plunger barrel and pump housing increased.

As described above, according to the invention, the shape of the inner wall of the plunger barrel and the shape of the peripheral surface of the timing sleeve may be designed to lower the pressure of fuel which sprays out in the spill step following fuel injection which accompanies raising the plunger, thereby preventing erosion and increasing the durability of the plunger barrel and pump housing.

What is claimed is:

1. A fuel injection pump comprising:

a pump housing having an inside wall, a plunger barrel positioned within the pump housing facing the inside wall of the pump housing and having a fuel pressure chamber and an inside wall, a plunger which reciprocates within this plunger barrel to take in fuel from a fuel reservoir chamber and deliver this fuel from the fuel pressure chamber under pressure, and a timing sleeve, positioned between the plunger and the plunger barrel such that it slidably mates with the plunger, the timing sleeve having a spill port and a peripheral surface facing the inside wall of the plunger barrel;

an impingement-cushioning cavity formed in the inside wall of the plunger barrel in a position opposite the spill port of the timing sleeve, the impingement-cushioning cavity having a curved portion with an open end of a width, W, and having flat surfaces extending in opposite directions from said open end and the peripheral surface of the timing sleeve in which the spill port is formed having flat and curved portions, the flat portion facing the open end of the impingement-cushioning cavity and being substantially parallel to the flat surfaces of the impingement-cushioning cavity and having a length no greater than the width W of said open end and the curved portions having a curvature generally corresponding in shape to this impingement-cushioning cavity;

the shapes of said impingement-cushioning cavity and the peripheral surface of the timing sleeve being such as to provide a sufficiently large distance from the spill port to the inside wall of the plunger barrel and a sufficiently large distance from a point of collision of the fuel sprayed out from the spill port on the inside wall of the plunger barrel to the inside wall of the pump housing to reduce the force of the fuel impinging on the inside wall of the plunger barrel and the inside wall of the pump housing to a level insufficient to cause erosion.

2. The fuel injection pump of claim 1 in which the shapes of the impingement-cushioning cavity and the peripheral surface of the timing sleeves are such as to reduce an angle of collision at which the fuel sprayed-out collides with the inside wall of the pump housing.

3. The fuel injection pump of claim 1 in which the impingement-cushioning cavity and the peripheral surface of the timing sleeve are formed in shapes which disperse the the fuel sprayed-out.

4. The fuel injection pump of claim 1 in which the impingement-cushioning cavity and the peripheral surface of the timing sleeve are formed in shapes which do not form restricting areas in areas over which the fuel sprayed out from the spill port passes.

* * * * *